United States Patent [19]

Andersson et al.

[11] Patent Number: 4,661,119

[45] Date of Patent: Apr. 28, 1987

[54] COKE BRIQUETTES

[75] Inventors: D. Bertil Andersson; Nils J. W. Juhlin; Claes I. Gillenium, all of Skovde; Olle Kjell-Berger, Valdemarsvik; Owe R. Brinck, Hassleholm, all of Sweden

[73] Assignee: Rockwool Aktiebolaget, Skovde, Sweden

[21] Appl. No.: 786,159

[22] Filed: Oct. 10, 1985

Related U.S. Application Data

[63] Continuation of Ser. No. 593,702, Mar. 26, 1984, abandoned.

[51] Int. Cl.[4] ..... C10L 5/02; C10L 5/12

[52] U.S. Cl. ..... 44/10 C; 44/16 R

[58] Field of Search ..... 44/16 A, 16 C, 16 R, 44/10 C

[56] References Cited

U.S. PATENT DOCUMENTS

| | | | |
|---|---|---|---|
| 563,162 | 6/1896 | Gontner et al. | 44/21 |
| 1,246,807 | 11/1917 | Ellis | 44/16 R |
| 3,762,886 | 10/1973 | Triska | 44/16 A |
| 4,093,451 | 6/1978 | Cass et al. | 44/16 A |
| 4,405,331 | 9/1983 | Blaustein et al. | 44/16 R |

*Primary Examiner*—Carl F. Dees

*Attorney, Agent, or Firm*—Thomas P. Sarro

[57] ABSTRACT

A briquette, preferably intended for use as additional combustible in shaft furnaces for melting of mineral in mineral wool manufacture and comprising 30–75% of a combustible in the form of coal and/or coke, 8–35% of a hydraulic binder like cement and 15–35% of a filler in the form of a fine grain, oxidic, mineral component like sand, slag, stone powder, fly ash, lime stone powder, dolomite powder, silicon dioxide or a fibrous waste material from the mineral wool manufacture.

5 Claims, No Drawings

COKE BRIQUETTES

This application is a continuation of application Ser. No. 593,702 filed Mar. 26, 1984 now abandoned.

When making and handling coke small pieces and coke dust always is broken away, and there is a less demand for such small fractions than for larger pieces of coke. Therefore the said small fractions have become a problem in giving an excess situation and a low price.

Since long there has consequently been an interest in finding such use for the small coke fractions. One suggested way of using the small coke fractions has been to make briquettes in the same way as making briquettes of large pieces of coke.

The above mentioned problem in respect to coke has appeared in connection to coal and when speaking in the following about coke it is to be understood that said expression also includes mineral coal and char coal.

Many previous patents deal with methods of making coke briquettes and the composition of such briquettes. When making coke briquettes the fine coke material is mixed with some type of binder like cement or ceaent mixtures, bitumen products, lime, sulphite containing organic binders, sulphate containing organic binders.

Some binders like cement or cement mixtures have been considered unsuitable in that such materials are not combustible, in that the briquette as a whole gets a poor heat effeciency considering the weight and in that it has been considered difficult to get the briquette burn. Other binders like bitumen products and organic binders provide unhealthy gases and harmful by-products when combusted. Most binders also give rather large amounts of ashes and waste products.

It is also obvious that the costs for the binder and the production costs in the briquette process must be rather low since the usefulness of the briquettes are highly depending on the final price. As soon as the costs for making briquettes, including the binder cost, comes closer to the price difference between small fractions and coarse fractions of the same combustible the consumer prefers to by the coarse fraction coke or the coarse fraction coal rather than the more or less untested briquettes. The rather high production costs for the briquettes probably has been the reason why many briquette patents never have resulted to a practical performance on large scale.

A further problem which is also notified in some of the previous patents is that the briquettes may fall apiece depending on the heat and pressure and in other word that the briquettes have a bad "fire strength" or heat strength. A large portion of the utilized coke is consumed in shaft furnaces. Thereby the low heat strength of the briquettes may become a critical problem since the briquettes far down in the furnace are being subjected to high temperatures at the same time as subjected to the pressure of the column to be heated or melted, for instance a stone column existing above the briquettes. Thereby briquettes having a low fire strength are being crumbled thereby blocking the furnace shaft, and as a consequence problems appear which are quite obvious to the expert. Further a large fire surface is subjected for the rising hot stack gases and this leads to a very strong reduction of the carbon monoxide of the stack gases and the process gives large losses of combustion. This is the reason why briquettes so far have generally not been used in shaft furnaces.

According to a previously patented method mineral coal pitch is used as a binder for the coke particles. The pitch is brought to cokify after the briquette is formed. For some purposes such briquettes have proved to be very interesting but they are rather expensive as a consequence of the expensive production process, and such briquettes therefore are out of interest, possibly except for very special purposes.

The present invention intends to solve the problem of the previously known briquettes and to provide a briquette which can be made at a reasonable low cost at the same time as having a sufficient fire strength for being used in shaft furnaces. The invention has appeared when developing coke briquettes especially for shaft furnaces and useful for melting of mineral in mineral wool manufacture, but obviously said use does not differ from other types of use, and it may be predicted that the briquette according to the invention is also useful for other said purposes.

According to the invention the briquette comprises at least three components: A first component being particles of coke or coal or both. The second component is a hydraulic binder, preferably cement. It is previously known to use both of said components in a combination in similar connections. The third component, which is also characterizing for the invention as used in the briquette is a fine grain oxidic, mineral component, for instance stone powder.

The invention probably functions in that the cement together with the fine grain, oxidic, mineral component provides a matrix which surrounds and interconnects the coke and coal particles respectively. By a suitable choice of ingredients the said matrix can be made sufficiently strong for use both in cold and hot stage.

In order to give the briquette an increased strength the finest coke or coal particles are left out, for instance in that such particles are screened away. The intended result is obtained already upon screening away particles which are less than 2 mm. A substantially better result, however, is obtained if at least the largest portion of coke and coal particles having less dimension than 5 mm are removed. The upper size limit of the coke and coal particles substantially is a practical question. A suitable upper limit is 25 mm. Particles having a size of more than 25 mm have a satsifactory sale value and therefore it is not economical to enter such particles in a briquette.

The fine grain, oxidic, mineral material preferably should not be coarser than 2 mm.

Of course the strength of the briquette is increased within certain limits by an increasing content of cement. It has proved that the amount of cement should be at least 7% as calculated on the dry weight of the briquette. The upper limit of the cement amount is more of economical than technical nature, but above a certain value, which can be said to be about 95%, the strength of the briquette is not increased to such extent that a further increase of the cement amount is meaningful.

Depending on which type of fine grain, oxidic, mineral material is used certain limits also can be stated. Empirically and considering extensive tests it has shown that practically useful briquettes rarely can be obtained if the amount of fine grain, oxidic, mineral material is less than 15% as calculated on the dry weight of the briquette.

It is of course self explanatory that a fine grain, oxidic, mineral component is chosen which is disadvantageous to the process in any respect, but which on the contrary is good for the process. When for instance manufacturing mineral wool it is generally wanted to add some lime stone or dolomite to the basic material which generally is a basalt type. It is also possible to chose slag, for instance steel slag and preferably a basic steel slag. To the fine grain, oxidic, mineral component or additionally thereof components of a more specific kind may be added, for instance oxides which make the melted mineral or the slag more thin-fluid.

When making mineral wool waste products always are obtained. Some of said waste products is fibrous and give a waste product problem depending on the bulky nature thereof. The said waste product, however has the necessary fine grain material, and the fibres of the waste product act reinforcing on the briquettes. If a fibrous waste material from the mineral wool manufacture is added at least as a part of the fine grain, oxidic, mineral material of the briquette substantial advantages are obtained as concerns the strength of the briquettes and the problems of getting rid of the waste material.

Surprisingly it has shown that the material which was added to the melted product together with the oxidic components of the briquettes distribute substantially homogenous and quicker in the final product than if added separately. The reason for this probably is that the coke particles and the coal particles respectively get pores when combusted which make the reaction surface very large. Therefore it is suitable to add a relatively large amount of the said materials of addition to the briquettes, which thereby reduce the amount of coke and coal particles respectively. The amount of coke and coal particles however, preferably should not be less than 30% of the dry weight of the briquette.

In briquettes according to the invention a further important advantage can be obtained. It is known that the exhaust gases of coke combusted shaft furnaces contain sulpher which have a strong and unpleasent smell. This smell can be eliminated by combustion, whereby the carbon monoxide present in the exhaust gases is the main fuel. The carbon monoxide, however, as a rule must be completed with some other fuel like a gas or an oil. Since the briquettes are now made with a base of coke or coal particles the exhaust gases are enriched with the volatile substances from the coke or the coal so that no addition of fuel is necessary. At least 10% of the coke-coal mixture should consist of coal particles in order that a substantial effect should be noted. If it proves that more than 50% coal particles should be needed it is better to use both coal briquettes and coke briquettes or possible just coal briquettes.

In the following the invention will be enlightened by means of a number of examples. During the development period it has been shown that briquettes having a pressure strength of less than 2,943 kPa (30 kg/cm$^2$) do not have sufficient pressure strength for being fed and charged in a furnace. The heat strength has been settled after heating the briquette to 900° C. for one hour. The development has shown, that briquettes which have a warm pressure strength of less than 981 kPa (10 kg/cm$^2$) after such heat treatment have only small possibilities of functioning adequately.

EXAMPLE 1

In a mixing mill the following was mixed:

| | |
|---|---|
| Coke, size/piece 2-25 mm | 810 kg (60%) |
| Portland cement | 175 kg (13%) |
| Sand | 365 kg (27%) |

-continued

| | |
|---|---|
| In total | 1,350 kg |

The briquettes are made in a formation machine for concrete products whereby the briquettes are shaped as cubes having an edge of about 8 cm. The wet cubes are stored for 12 days, whereupon they are dried for 24 hours and at a temperature of 60° C.

The pressure strength of the briquettes in cold state is measured to 2,639 kPa (26.9 kg/cm$^2$), which value is an average value of six briquettes.

For making it possible to check the heat strength of the briquettes they are subjected to a temperature of 900° C. for one hour, whereupon they were allowed to cool for 24 hours before the heat strength was measured. A value of 2,246 kPa (22.9 kg/cm$^2$) was obtained, which value is an average value for six briquettes.

Briquettes having the above identified composition have a pressure strength in cold state which is slightly less than the above mentioned recommended value of about 2,943 kPa (30 kg/cm$^2$), whereas the heat stength is substantially higher than the above mentioned recommended value of 981 kPa (10 kg/cm$^2$).

In the following tables A and B an additional number of examples are given for different mixtures for the manufacture of briquettes, whereby the tables give information about composition, pressure strength, heat strength, evaluation of the strength and observations:

TABLE A

| | Coke | | Portland cement | | Filler | | |
|---|---|---|---|---|---|---|---|
| Example | kg | % | kg | % | kg | % | type |
| 2 | 810 | 60 | 175 | 13 | 365 | 27 | limestone powder |
| 3 | 810 | 60 | 175 | 13 | 135 | 10 | slag |
| | | | | | 230 | 17 | sand 2 mm |
| 4 | 1080 | 80 | 270 | 20 | — | — | — |
| 5 | 868 | 65 | 175 | 13 | 297 | 22 | sand 2 mm |
| 6 | 945 | 70 | 108 | 8 | 243 | 18 | fly ash |
| | | | | | 54 | 4 | limestone powder |
| 7 | 945 | 70 | 108 | 10 | 135 | 10 | slag |
| | | | | | 135 | 10 | $SiO_2$ |
| 8 | 945 | 70 | 68 | 5 | 270 | 20 | limestone powder |
| | | | | | 67 | 5 | slag |
| 9 | 945 | 70 | 162 | 12 | 243 | 18 | Rockwool-saw dust |
| 10 | 945 | 70 | 135 | 10 | 135 | 10 | limestone powder |
| | | | | | 135 | 10 | $SiO_2$ |
| 11 | 675 | 50 | 310 | 23 | 365 | 27 | sand 2 mm |
| 12 | 1080 | 80 | 175 | 13 | 95 | 7 | slagg |
| 13 | 743 | 55 | 135 | 10 | 202 | 15 | kalkmjol |
| | | | | | 270 | 20 | slag |
| 14 | 405 | 30 | 472 | 35 | 473 | 35 | sand 2 mm |
| 15 | 945 | 70 | 135 | 10 | 68 | 5 | slag |
| | | | | | 202 | 15 | Rockwool-rejected material |

*waste material from wet separation of mineral wool

TABLE B

| | Pressure strength | Heat strength | Pressure & heat strength | | |
|---|---|---|---|---|---|
| Example | kPa | kPa | acc. | not acc.* | Observation |
| 2 | 2551 | 1148 | | x | coke 2-25 mm |
| 3 | 3895 | 3345 | x | | coke 2-25 mm |
| 4 | 3188 | 421 | | x | coke 2-25 mm |
| 5 | 2207 | 765 | | x | coke 0-25 mm |
| 6 | 2963 | 1030 | x | | coke 2-25 mm |
| 7 | 3404 | 892 | x** | | coke 2-25 mm. **with hesitation, 892 close to limit |
| 8 | 2502 | 334 | | x | coke 2-25 mm |
| 9 | 1050 | 451 | | x | coke 2-25 mm |

TABLE B-continued

| Example | Pressure strength kPa | Heat strength kPa | Pressure & heat strength acc. | not acc.* | Observation |
|---|---|---|---|---|---|
| 10 | 3092 | 1334 | x | | coke 2–25 mm |
| 11 | 1481 | 1109 | | x | coke 2–25 mm |
| 12 | 2384 | 441 | | x | coke 2–25 mm |
| 13 | 1246 | 912 | | x | coke 2–25 mm |
| 14 | 3326 | 2011 | x | | coke 2–25 mm, too expensive cons. the low coke content |
| 15 | 2972 | 1001 | x | | coke 2–25 mm |

*accepted/not accepted

The measured pressure strength is slightly less than the recommended value of 2,943 kPa (30 kg/cm$^2$) in examples 1, 2, 5, 8 and 12. As concerns the examples 9, 11 and 13 tne indicated pressure strengths are clearly non-acceptable. The examples indicating accepted values for pressure strength are examples 3, 4, 6, 7, 10, 14 and 15.

As concerns heat strength, which should be at least 981 kPa (10 kg/cm$^2$), accepted values were obtained in examples 1, 2, 3, 6, 10, 11, 14 and 15, whereas the heat strengthes in examples 4, 5, 8, 9, 12 and 13 are far below the least accepted value. In examples 7 and 13 the heat strength is between 883 and 981 kPa, which may be considered acceptable values considering that there is some marginal of faulse measurements.

The examples giving acceptable pressure strength in the cold state and acceptable heat strength are examples 3, 10, 14 and 15, and with some hesitation example 7. This indicates that the composition of the briquettes should be between the following values:

| | |
|---|---|
| Coke (or coal/coke mixture) | 30–75% |
| Cement | 8–35% |
| Filler material | 15–35%. |

We claim:

1. A briquette suitable for use as an auxiliary fuel in a shaft furnace for melting of mineral in the manufacture of mineral wool comprising:

(a) 30–75% by weight, based on the dry weight of the briquettes, of particles of coke fines or coal fines or both, said fines consisting essentially of particles having a particle size of from 2 to 25 mm;

(b) at least 7% by weight, based on the dry weight of the briquette, of a hydraulic binder; and (c) at least 15% by weight, based on the dry weight of the briquette, of a fine grain oxidic mineral component selected from the group consisting of sand, slag, stone powder, fly ash, limestone powder, dolomite powder, silicon dioxide, and waste material from mineral wool manufacturer, said fine grain oxidic mineral component having a particle size of less than 2 mm.

2. A briquette according to claim 1 wherein component (a) comprises a mixture of coal and coke particles, the amount of coal particles being 10–50% by weight of the mixture.

3. A briquette according to claim 1 wherein compound (b) comprises cement in an amount of 8–35% by weight, based on the dry weight of the briquette.

4. A briquette according to claim 1 wherein component (c) is present in an amount of up to 35% by weight, based on the dry weight of the briquette.

5. A briquette according to claim 1 wherein said minimum particle size of component (a) is 5 mm.

* * * * *